United States Patent [19]

Noone

[11] Patent Number: 4,866,861

[45] Date of Patent: Sep. 19, 1989

[54] SUPPORTS FOR GOLF SHOES TO RESTRAIN ROLLOUT DURING A GOLF BACKSWING AND TO RESIST EXCESSIVE WEIGHT TRANSFER DURING A GOLF DOWNSWING

[75] Inventor: Tom Noone, Abington, Mass.

[73] Assignee: MacGregor Golf Corporation, Albany, Ga.

[21] Appl. No.: 222,262

[22] Filed: Jul. 21, 1988

[51] Int. Cl.[4] ..... A43B 5/00; A43B 23/08

[52] U.S. Cl. ..... 36/127; 36/69; 36/134; 273/32 C; 273/187 B

[58] Field of Search ..... 36/127, 134, 68, 69; 273/32 C, 187 B

[56] References Cited

U.S. PATENT DOCUMENTS 3,218,734 11/1965 O'Brien ..... 36/127 X 4,288,929 9/1981 Norton et al. ..... 36/69

4,407,079 10/1983 Chiroff ..... 36/127

FOREIGN PATENT DOCUMENTS 223894 3/1958 Australia ..... 36/127

WO87/07480 12/1987 World Int. Prop. O. ..... 36/127

*Primary Examiner*—James Kee Chi

*Attorney, Agent, or Firm*—Jones, Askew & Lunsford

[57] ABSTRACT

A golf shoe having an instep support rigidly connected to the sole between the instep and the toe of the golf shoe, the instep support extending over the edge of the sole adjacent the shoe, and a heel restraint extending upwardly from the sole, both the instep support and the heel restraint extending upwardly on the lateral outside of the golf shoe to restrain outward rolling of the foot during a backswing and to promote a firm side to hit against during the power stroke.

16 Claims, 3 Drawing Sheets

SUPPORTS FOR GOLF SHOES TO RESTRAIN ROLLOUT DURING A GOLF BACKSWING AND TO RESIST EXCESSIVE WEIGHT TRANSFER DURING A GOLF DOWNSWING

TECHNICAL FIELD

The present invention relates to golf shoes. More particularly, the present invention relates to shoe supports fixed to the sole and to the side of the shoe to promote a proper golf club swing by a golfer by restraining the golfer's foot from rolling outward during the back stroke of a golf swing thereby allowing the leg muscles to attain maximum stretch for a more powerful swing and by resisting transfer of the golfer's weight in advance of the club head during the power swing.

BACKGROUND OF THE INVENTION

Various golf professionals stress the importance of the golfer keeping his weight on the insides of the feet during the backswing of the golf club. Tom Watson writes in the January 1988 Golf Digest magazine article "Footwork Basics" that "the weight should not drift to the outsides of the feet." Jack Nicklaus teaches in his instruction book *Golf My Way* to "play from the insides of (the) feet and to find a stance width that permits effective body action without throwing weight to the outsides of the feet." An improper stance and lack of control over weight distribution during the back stroke of the golf swing encourages the tendency of the back foot to roll outward. This causes the golfer to lose his balance and sway. Poor balance and an awkward swing contributes to a weak drive or an innacurate drive. Keeping the foot from rolling outward during the backswing of the golf club is one element of a strong accurate golf swing.

During the downswing and impact of the golf club with the golf ball, the golfer's weight shifts forward. The golfer's forward foot properly rolls outward during the followthrough of the golf club. Sometimes the golfer's weight shifts in advance of the golf swing and impact. This also causes the golfer to lose his balance and to swing awkwardly. Keeping the golfer's weight from shifting in advance of the golf club during the power stroke is another element of a strong accurate golf swing.

Golf shoes have included cleats which grip the ground to help the golfer have a firm stance. Other shoe devices are also directed towards helping the wearer have a firm stance or increased traction. U.S. Pat. No. 2,179,942 describes an attachment for a golf shoe located adjacent the big toe joint or adjacent the instep curve of the sole of the shoe. The attachment device has an outward extension ledge portion which may be positioned between the upper portion of the shoe and the welt and attached by screws or rivets to the edge, bottom, welt, or other portion of the shoe. The device attaches to the medial side of the shoe, which for a right shoe is the left side. (The lateral side on a right shoe is the right side; for a left shoe, the lateral side is the left side.) Studs or spikes are positioned in the attachment to prevent the golfer's foot from slipping during the pivot action. Such an apparatus may be used by a right handed golfer who pivots about the inner edge of the left shoe while moving the club in the backswing. A left-handed golfer would pivot about the inner edge of the right shoe.

While the described apparatus may prevent slipping of the shoe during the pivot action, some golf professionals and other golf instructors urge that the golfer not roll his foot outward during the backswing of the golf club, but play from the insides of the foot. Also, a golfer's weight should not shift from his back foot to his front foot in advance of the golf club during the downstroke and impact of the golf club with the golf ball. Thus, use of the '942 golf shoe attachment may encourage poor golf swings by attempting to solve problems associated with pivoting on the inner edge of the golf shoe rather than contribute to the golfer practicing a proper golf stance and swing.

U.S. Pat. No. 3,769,723 describes a shoe in which the inner side expands to absorb the energy of an impact by a substantial force on the shoe. The shoe is described as reducing injury by allowing the foot to move laterally out of the shoe over the sole and heel portion. The shoe also provides additional support for the foot by including a pair of thin flat spring metal retaining members in the rear quarter of the shoe to embrace a substantial portion of the heel of the wearer. Such a shoe however would not be practical for the game of golf in which the player wants to be positioned firmly on the ground. The golfer swinging a golf club needs his feet to be stable within the shoe and the feet to cooperate with the shoe while the golfer pivots during the swing. A shoe which permits the foot to slip with respect to the shoe is not desirable for a person playing golf.

U.S. Pat. No. 4,454,662 describes an arch support for an athletic shoe. The support includes a cup-shaped heel portion with an inner side wall and an outer side wall connected by a curved rear wall extending from the sole of the shoe towards the ankle of the wearer. The inner side wall is higher than the laterally corresponding portion of the outer side wall. This differential in height increases towards the arch and toe portion of the sole. The outer wall tapers downwardly more quickly and provides no side structure adjacent the outside lateral portion of the shoe between the instep and the toes. The cup-shaped heel provides rigidity and support especially for the inner arch. Such a shoe providing arch support would be useful for games such as football or soccer. The shoe however would not contribute to restricting the tendency of the foot to roll outward during the back stroke of a golf swing. The shoe described in the '662 patent does not provide a side structure on the outside of the shoe forward of the instep.

U.S. Pat. No. 4,510,701 describes an athletic shoe which provides a rigid external cup-form counter to reduce transverse movement or axial movement of the foot in the shoe during movement of the individual wearing the shoe. The external shoe counter extends around the shoe upper in the heel portion. Eyelets defined in the molded body of the counter receive a shoelace before the lace is securely tied proximate to the juncture of the upper surface of the foot and the front surface of the leg. The force exerted by the shoelace draws the side portions of the counter forward and upward. The counter thus tightly grips the shoe about the heel to restrain transverse or axial movement of the foot within the shoe.

Such a counter apparatus is designed to restrain the heel portion of the foot within the shoe by tightening the quarter of the shoe around the heel. Golf is a game which requires a significant amount of walking, and the counter securely tied around the heel portion of the quarter may cause discomfort to the golfer as he is walking along a fairway, across a green, or tramping through the rough in search of a lost ball.

U.S. Pat. No. 4,559,724 describes a sole for a track shoe, which includes a plate which extends substantially the entire length of the shoe. A pair of lateral traction extensions are formed integral with the plate and extend from the bottom surface of the plate adjacent and upwardly of the fifth metatarsalphalanges joint. A gap separates the traction extensions. A first second and third flex groove is formed in the plate to enhance the flexibility of the plate along the grooves; the gap is aligned with the lateral end of the medial groove. The grooves reduce the thickness of the plate to approximately half that of the surrounding area of the plate. Two of the grooves are substantially parallel; one of the parallel grooves connects with the third groove on the medial side of the foot.

The present invention overcomes the deficiencies of previous golf shoes or athletic shoes by providing a structure to restrain the golfer's foot from rolling outward during a golf backswing and to provide a firm side to hit against on the downswing or power stroke. Such outward rolling of the foot may occur during the backswing causing the golfer to be improperly positioned for a strong power stroke. For a right-handed golfer taking a backswing, the golfer's weight shifts from the address position evenly distributed over both feet to being carried primarily by the right foot. The shift in weight and the backswing pivoting action tends to induce the right foot to roll outward by pivoting around the ankle. (A left-handed golfer's left foot attempts to roll outward during the backswing.) Preventing the foot from rolling outward with the golfer's weight on the inside of the right foot enables the leg muscles to stretch and extend fully. A golfer with his leg muscles fully extended when the golf club is at the top of the backswing experiences a rapid slingshot release of the muscle during the power stroke.

Such rollouts by the foot tend to disturb a golf swing by throwing the golfer off balance and positioning him awkwardly for the power swing through the golf ball. Foot rollout and body sway inhibit the leg muscles from properly extending. An out-of-balance golfer cannot swing smoothly or cleanly through the golf ball and thus the drive of the golf ball is affected.

Forward foot rollout may properly occur during the followthrough of the golf head after the power swing and impact with the golf ball. In this situation, the weight of a right-handed golfer is shifting from the right leg to the left leg while the golfer pivots from the backstroke into the power stroke. The weight shift combined with the pivot action tends to encourage the left foot to roll outward or pivot about the ankle. At the moment of golf club impact on the golf ball, a proper power swing returns the golfer's body to its original position as when he initially adressed the golf ball or to an advanced position just adjacent to that address position. During the downstroke and impact of the golf club, the golfer's weight however may shift in advance of, rather than with, the golf club travel. The present invention accordingly overcomes the deficiencies of previous golf shoes or athletic shoes by providing a structure which gives the golfer a feeling of resistance for a firm side to hit against during the golf downswing.

BRIEF DESCRIPTION OF THE PRESENT INVENTION

The present invention provides a first lateral support located between the instep and the toe of the golf shoe. The first lateral support includes a horizontal plate or overlay which connects to the sole of the golf shoe and a side member extending upwardly adjacent the side of the sole and conforming to the side of the shoe. A preferred embodiment has at least two upwardly extending side members or fingers. The first lateral support is rigidly attached by the overlay to the sole and by the side member to the side of the shoe. The bottom surface of the overlay preferably has a series of parallel grooves. A gap is defined between the inner edges of the upright fingers to provide flexibility to the shoe. For additional flexibility the first lateral support preferably is made from a more resilient material, such as rubber, than the material from which the sole is formed, such as urethane. Because of the significant amount of walking that occurs in a golf game, a comfortable shoe having flexibility in the instep area is important. Thus the present invention overcomes the competing interests for a shoe which restricts rollout but is flexible in the instep region of the shoe to permit comfortable walking.

A second rollout restraint is integral in the heel portion of the sole. A heel side support extends upwardly from the edge of the sole adjacent the lateral outside heel quarter of the shoe. This second support restricts the heel from rolling outward during the backswing.

A similar set of first and second lateral supports is located on the lateral outside of both the left and right shoes. For a right handed golfer, the first and second lateral supports provide upright structures on the left shoe for resistance during the power drive or downswing of the golfer creating a firm side to hit against.

Accordingly, it is an object of the present invention to restrain the tendency of the golfer's foot to roll outward during a backswing. This object includes two parts: first, to restrain the rolling of the ball of the foot during the initial portion of the backswing, and second, to restrain the rolling of the heel during the latter portion of the backswing when the golfer's weight shifts from the ball to the heel.

During the followthrough of the golf club after impact of the golf head on the golf ball, the golfer's forward foot properly is to roll outward. However, advanced rollout because the golfer's weight shifts untimely early is not desirable. It is an object of the present invention to provide a stiff substantially vertical surface to resist weight shift in advance of the golf club and to provide a firm side to hit against during the power downswing and impact on the golf ball.

It is a further object of the present invention to provide a golf shoe with sufficient flexibility for a comfortable walking shoe while including a firm support to restrain the foot from rolling during a golf swing.

BRIEF DESCRIPTION OF THE DRAWINGS

The various objects and advantages of the present invention will become further apparent upon reference to the accompanying drawings in which like elements have like identifiers.

DETAILED DESCRIPTION OF THE PREFERRED EMBODIMENTS

Figure 1:
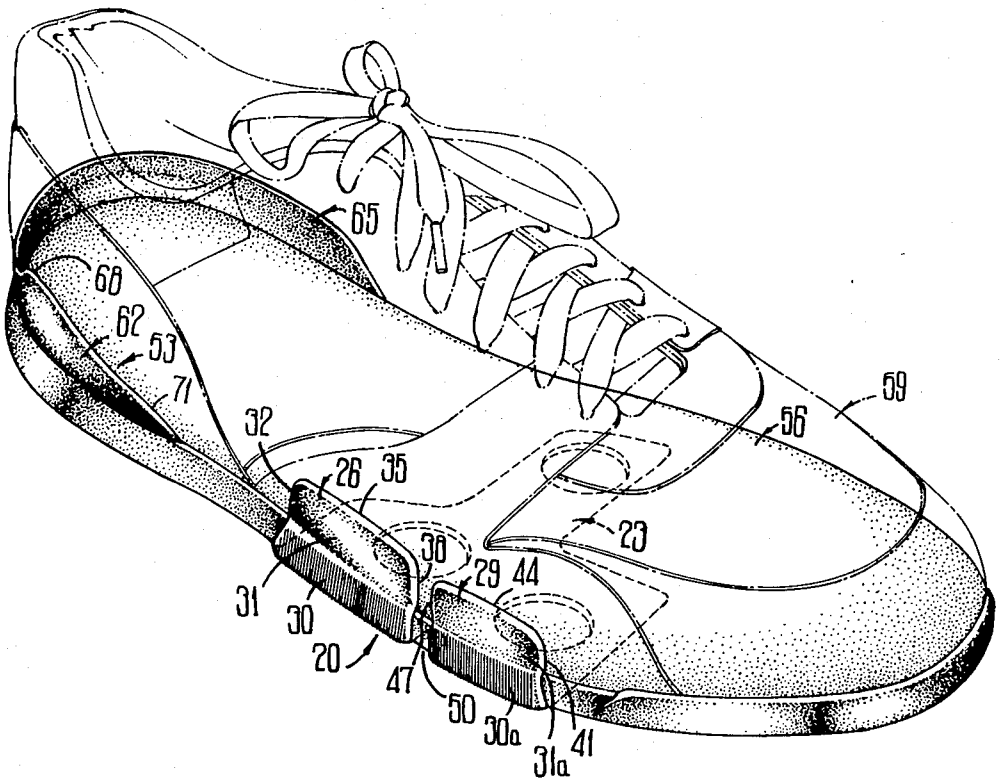
FIG. 1 is a perspective view of an instep lateral support for golf shoes according to the present invention to restrain instep rollout during a golf swing, and a perspective view of a heel support for golf shoes according to the present invention to restrain heel rollout during a golf swing, the golf shoe illustrated in phantom lines.

The present invention provides an instep support and a heel support on the lateral side of a golf shoe to reduce the tendency of the foot to roll outward during a backswing of a golf swing. Further, the instep support and heel support provide a resistance during the power swing and encourage the golfer to hold a firm side to hit against. Turning first to FIG. 1, there is illustrated in perspective view the instep support 20 of the present invention restrain rollout of the instep of the foot during a backswing and to create a firm side to hit against during the power stroke. The instep support 20 includes a horizontally disposed overlay 23 and a side member comprising two linerally adjacent side supports or fingers 26 and 29. The side supports 26 and 29 are integral with extend laterally from the overlay 23 and bend to reach vertically adjacent and over the overlay 23.

The side support 26 includes a heel side edge 32, a top edge 35 and an inner edge 38. Similarly, the longitudinally forward side member 29 has as toe side edge 41, a top edge 44 and an inner edge 47. The inner edge 38 and the inner edge 47 define a gap 50 between the support 26 and the support 29. In a preferred embodiment, the gap 50 extends a short distance into the overlay 23. Each side member 26 and 29 comprises a lower portion 30 and 30*a* respectively and an upper portion 31 and 31*a* respectively. The lower portions 30 and 30*a* extend substantially vertically adjacent the side of the sole 56 while the upper portions 31 and 31*a* curvedly have flare out to conform to the adjacent quarter side of the shoe.

The rollout restraint for golf shoes of the present invention also includes a heel rollout restraint 53 as illustrated in perspective view in FIG. 1. The heel restraint 53 according to the present invention is integral with the sole 56 of the golf shoe 59. The cup-shaped heel restraint 53 includes an outside support 62 and an inside support 65. The outside support 62 reaches higher up the quarter of the shoe 59 than does the inside support 65. The outside support 62 and the inside support 65 are integrally connected in the cup-shaped heel area of the sole. The inner sole of the shoe 56 forms a shallow dish area which conforms to the shape of a heel. The sole 59, the outside support 62 and the inside support 65 together define the shallow bowl area in the sole 56 to accept a heel.

The heel end 68 of the outside support 62 reaches higher along the shoe quarter than does the toe end 71. The outside support 62 extends from the heel above the top of the sole 56 and tapers down to the sole 56 adjacent the instep. The outside support 62 of the present invention preferably reaches higher adjacent the heel quarter of the shoe 59 than does the corresponding portion of the inside support 65.

Figure 2:
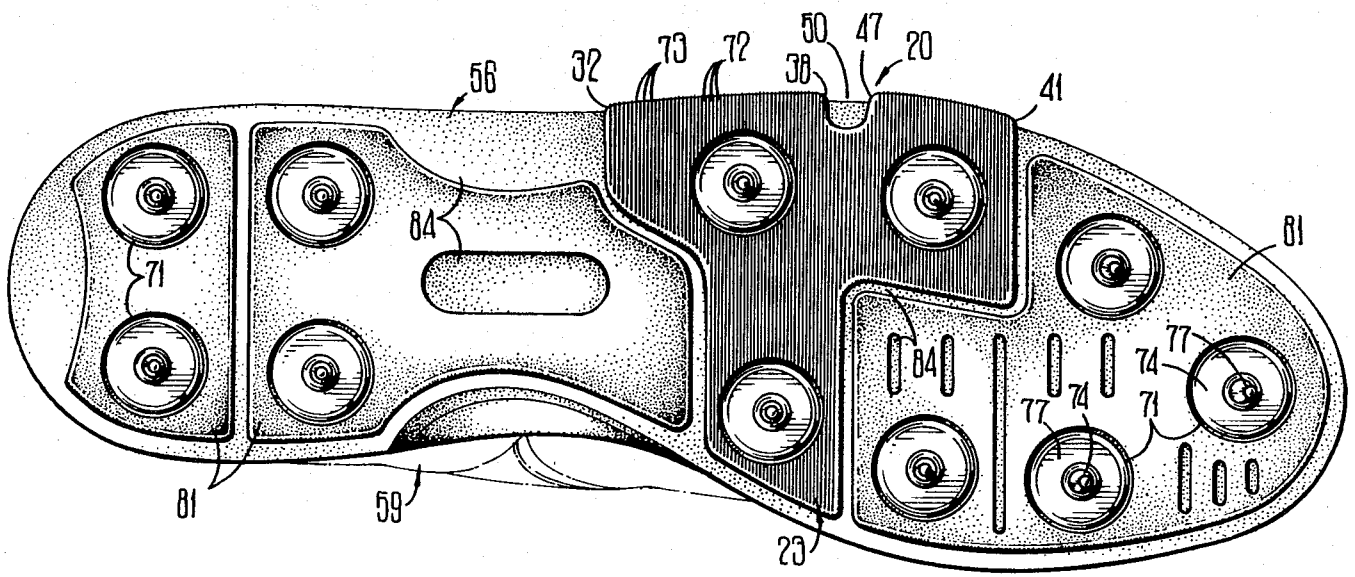
FIG. 2 is a bottom view of a golf shoe including the instep lateral support of the present invention to restrain instep rollout during a golf swing.

FIG. 2 illustrates a bottom view of a golf shoe 59 incorporating the instep support 20 of the present invention. The upper surface of the support 20 is bonded by one of a variety of means rigidly to the bottom surface of the sole 56. The support 20 preferably is glued with adhesive to the sole 56 and the side quarter of the shoe 59. The gap 50 defined by the inner edges 38 and 47 extends into the overlay 23. The overlay 23 extends from adjacent the medial side of the shoe to the lateral side transverse to the longitudinal axis of the shoe 59. In the illustrated embodiment, a series of parallel grooves 72 define ridges 73 in the bottom surface of the overlay 23. The grooves 72 and the ridges 73 are transverse to the longitudinal axis of the shoe.

As known in the art, the sole 56 of the golf shoe 59 includes a plurality of cleats 71. The illustrated cleats 71 are a screw-in type and include a cleat post 74 and a cleat disk 77. The distal portion of the cleat post 74 is threaded to be received by a bore in the sole 56 as is known in the art. The instep support 20 of the present invention can be gainfully employed with a shoe which includes cleats molded into the sole (not illustrated) during manufacture of the sole. An alternate embodiment of the instep support 20 defines apertures in the overlay 23 through which either a molded cleat extends from the sole 56 or through which a screw-in type cleat 71 may be connected to the sole 56. Such an aperture provides a well in the overlay 23 which receives the cleat disk 77.

The sole 56 of the golf shoe illustrated in FIG. 2 includes a plurality of land areas 81 and sub-land areas 84. A variety of patterns of land areas 81 and sub-land areas 84 may be selected for the sole as desired.

Figure 3:
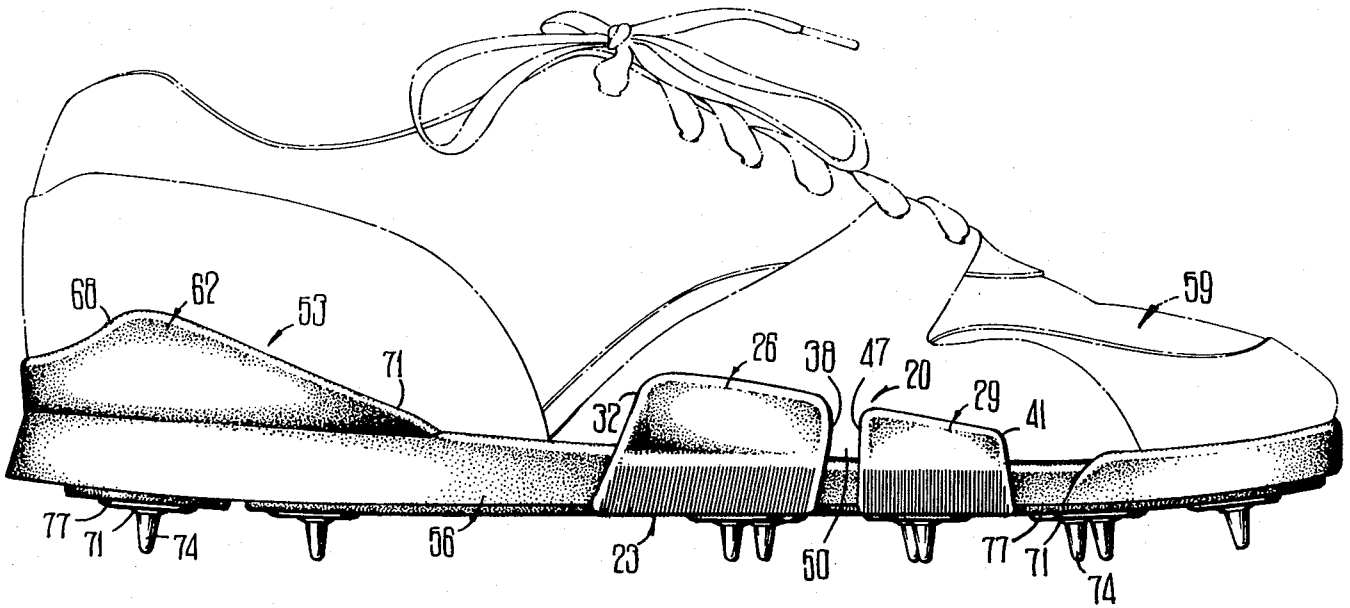
FIG. 3 is a side view of a golf shoe which includes the instep lateral support and the heel support to restrain foot rollout according to the present invention.

Turning now to FIG. 3, there is illustrated in side view a golf shoe 59 which includes the instep support 20 of the present invention and the heel restraint 53 of the present invention. The instep support 20 includes the side support 26 and the side support 29. Each of the side supports 26 and 29 extend upwardly from the overlay 23 adjacent the edge of the sole 56 and along side the lower quarter if the shoe 59. In the illustrated embodiment, the side support is greater in area than the side support 29 and the side support 26 reaches higher along the side of the shoe 59 than does the toe-side upright member 29. The inner edges 38 and 47 of the upright members 26 and 29 respectively define the gap 50 between the upright side supports 26 and 29. The heel support 62 is integral with the sole 56 and extends upwardly from the sole 56 adjacent the heel before tapering downwardly to the sole 56 adjacent the instep.

The instep support 20 and the heel support 62 cooperate to restrain the foot from rolling outward during a backswing and to create a firm resistance to hit against during the power swing. Glue or other adhesive is applied to the upper surface of the overlay 23 of the instep support. Adhesive is also applied to the inside surface of the side supports 26 and 29. The instep support 20 thus is rigidly secured with adhesive to the sole 56 of the golf shoe 59. The heel restraint 53 is integral with the sole 56. The inner surface of the upwardly extending heel support 62 is also connected rigidly to the shoe 59. In a preferred embodiment, the sole is molded from urethane and the instep support 20 is molded from rubber. The urethane sole 56 provides a firm support 20 for the golfer as well as providing a base to receive the threaded post 74 of the metal cleats 71. The rubber overlay for the instep support 20 provides sufficient flexibility for comfortable walking.

The side supports 26 and 29 contribute to restraining the foot from rolling as the golfer's weight shifts during the backswing from even distribution on both feet when the golf ball is addressed to primary distribution on the back foot which for a right handed golfer is the right foot. During the backswing the golfer's foot tends to pivot around the ankle and cause the foot to roll outward. Such an outward roll by the foot is restrained by the side supports 26 and 29 extending from the instep support 20. As the golfer's weight continues to shift during the backswing, the rolling effect moves to the heel portion of the golfer's foot. The heel support 62 cooperates with the instep support 20 to restrict rolling of the instep and the heel portions of the foot, and facilitates keeping the golfer's weight on the inside of the foot. This permits the large muscles in the golfer's right leg to stretch and expand. Proper positioning of the foot enables full extension of the leg muscles when the golfer is positioned at the top of the backswing.

When the golfer begins the arcuate downswing of the club towards the golf ball, the fully extended leg muscles rapidly and powerfully release. This power position increases club head speed and drive accuracy. During the downswing towards impact of the golf head on the golf ball, the golfer's weight shifts from the back foot to the forward foot which for a right handed golfer is the left foot. The instep support 20 and the heel support 62 on the outside of the left golf shoe resist the golfer's tendency to permit his weight to shift in advance of the golf club and to prematurely roll the forward foot outwardly during the golf swing. Thus, the supports allow the large muscles of the right leg to attain their maximum stretch during the backswing, provide for a more powerful swing, and restrain advanced weight shift during the power stroke.

An alternate embodiment of the present invention may be used with leather shoes by rigidly connecting the overlay 23 between the sole and the insole of the golf shoe.

The gap 50 defined by the inner edges 38 and 47 of the side supports 26 and 29, respectively, facilitates the golf shoe to flexibly bend at the ball of the foot transverse to the longitudinal axis of the golf shoe. Such flexibility is important in contributing to the comfort and walkability of the shoe incorporating relatively rigid structures to restrain rollout of the foot during the golf swing and to resist advanced weight transfer.

The principles, preferred embodiments and modes of operation of the present invention have been described in the foregoing specification. The invention is not to be construed as limited to the particular forms disclosed, because these are regarded as illustrative rather than restrictive. Moreover, variations and changes may be made by those skilled in the art without departing from the spirit of the invention as defined by the following claims.

What is claimed is:

1. A side support to be rigidly connected to a golf shoe to restrain the shoe from rolling outward during a gold swing, comprising:

a planar overlay rigidly connected to the sole; and a side member extending from the edge of the overlay upward along the side of the sole and over a portion of the shoe adjacent the lateral side of the foot.

2. The side support as recited in claim 1 wherein the side member includes at least two fingers, adjacent fingers defining a gap between the inside edges of the fingers.

3. The side support as recited in claim 1 wherein the overlay defines at least one well for receiving a cleat.

4. The side support as recited in claim 1 wherein the overlay includes a series of grooves transverse to the longitudinal axis of the shoe.

5. The side support as recited in claim 2 wherein each finger comprises a lower portion and an upper portion, the lower portion extending substantially vertically adjacent the side of the sole, the upper portion curvedly flaring out to conform to the adjacent shoe.

6. The improved golf shoe as recited in claim 5, wherein the overlay includes a series of grooves.

7. The improved golf shoe as recited in claim 6, wherein each groove is transverse to a longitudinal axis of the shoe.

8. An improved golf shoe restraining the tendency of a golfer's foot from rolling outward during a golf swing, the improvement comprising:

an instep support having a horizontal overlay attached to the sole of the golf shoe and integrally connected to an upwardly extending lateral instep member, the instep support positioned between the instep and the toes of the shoe; and a heel restraint integral with the sole and having a lateral side heel support extending upwardly from the upper edge of the sole adjacent the quarter of the shoe.

9. The improved golf shoe as recited in claim 8, wherein the horizontal overlay extends from adjacent the medial side of the sole to the lateral side of the sole transverse to the longitudinal axis of the shoe.

10. The improved golf shoe as recited in claim 8, wherein the lateral instep member includes at least two fingers, adjacent fingers defining a gap between the inside edges of the fingers.

11. The improved golf shoe as recited in claim 8, wherein the top edge of lateral side support of the heel restraint extends to a maximum height proximate a first heel end of the lateral side heel support and tapers downwardly towards a second instep end of the lateral side heel support.

12. The improved golf shoe as recited in claim 8, wherein the horizontal overlay includes a series of grooves transverse to the longitudinal axis of the shoe.

13. The improved golf shoe as recited in claim 8, wherein the lateral instep member extends upward along side of the sole and adjacent an instep side portion of the shoe.

14. An improved golf shoe restraining the tendency of a golfer's foot from rolling outward during a golf swing, the improvement comprising:

an instep support having a horizontal overlay attached to the sole of the golf shoe and integrally connected to at least two upwardly extending lateral instep fingers, the adjacent fingers defining a gap between the inside edges of the fingers, the gap extending into the overlay, the instep support positioned between the instep and the toes of the shoe; and a heel restraint integral with the sole and having a lateral heel support extending upwardly from the upper edge of the sole adjacent the quarter of the shoe, the heel support extending to a maximum height at a first heel end of the lateral heel support and tapering downwardly towards a second instep end of the lateral heel support.

15. An improved golf shoe as recited in claim 14, wherein the horizontal overlay extends from adjacent the medial side of the sole to the lateral side of the sole transverse to the longitudinal axis of the shoe.

16. An improved golf shoe as recited in claim 14, wherein the horizontal overlay includes a series of grooves transverse to the longitudinal axis of the shoe.

* * * * *